US005315350A

United States Patent [19]

Hirobe et al.

[11] Patent Number: 5,315,350

[45] Date of Patent: May 24, 1994

[54] IMAGE FORMING APPARATUS PROVIDED WITH A CONTROLLER FOR FIXING ROLLER HEATER

[75] Inventors: Junichi Hirobe, Kadoma; Masakatsu Akashi, Kakogawa; Masahiko Kobayashi, Ikoma; Tsutomu Sugaya, Hirakata, all of Japan

[73] Assignee: Mita Industrial Co., Ltd., Osaka, Japan

[21] Appl. No.: 848,557

[22] Filed: Mar. 9, 1992

[30] Foreign Application Priority Data

Mar. 12, 1991 [JP] Japan ..... 3-46450

[51] Int. Cl.[5] ..... G03G 21/00

[52] U.S. Cl. ..... 355/208; 219/216; 355/282; 355/285

[58] Field of Search ..... 355/208, 282, 290, 285, 355/283, 284, 286-289, 291-295, 160; 219/216, 469-471

[56] References Cited

U.S. PATENT DOCUMENTS

| | | | |
|---|---|---|---|
| 3,989,370 | 11/1976 | Mooney | 219/216 |
| 4,161,644 | 7/1979 | Yanagawa et al. | 219/216 |
| 4,595,279 | 6/1986 | Kuru et al. | 355/282 |
| 4,627,714 | 12/1986 | Nozaki | 219/216 X |
| 4,671,643 | 6/1987 | Shigemura et al. | 219/216 X |
| 4,719,489 | 1/1988 | Ohkubo et al. | 355/290 |
| 4,782,362 | 11/1988 | Mitsuya et al. | 355/288 |
| 4,996,567 | 2/1991 | Watarai et al. | 355/290 |
| 4,998,121 | 3/1991 | Koh et al. | 346/160 |
| 5,220,389 | 6/1993 | Kishimoto et al. | 355/285 |

FOREIGN PATENT DOCUMENTS

| | | |
|---|---|---|
| 0373654 | 6/1990 | European Pat. Off. . |
| 55-147654 | 11/1980 | Japan . |
| 57-112769 | 7/1982 | Japan . |
| 4-068385 | 3/1992 | Japan . |
| 4-121769 | 4/1992 | Japan . |

OTHER PUBLICATIONS

Patent Abstracts of Japan, vol. 14, No. 415 (P-1102) (4358) 7 Sep. 1990 & JP-A-02 161 482 (Canon) Jun. 21, 1990 *abstract*.

Patent Abstracts of Japan, vol. 12, No. 66 (P-671) (2913) Feb. 27, 1988 & JP-A-62 206 575 (Canon) Sep. 11, 1987 *abstract*.

Patent Abstracts of Japan, vol. 11, No. 26 (P-539) (2473) Jan. 24, 1987 & JP-A-61 198 263 (Canon) Sep. 2, 1986 *abstract*.

*Primary Examiner*—A. T. Grimley
*Assistant Examiner*—Shuk Y. Lee
*Attorney, Agent, or Firm*—Jordan and Hamburg

[57] ABSTRACT

An image forming apparatus includes an image forming unit for forming and transferring an image of a document to a copy sheet, fixing unit including a fixing roller for fixing the document image to a copy sheet while transporting it, a heater for heating the fixing roller, and heater control unit for turning on and off the heater at specified timings so as to increase and maintain temperature of the fixing roller to and in a predetermined steady-state temperature range whose upper limit is a fixing temperature, the copy sheet being heated by the fixing roller having temperature of about the predetermined fixing temperature while transported, whereby the document image transferred to the copy sheet is fixed thereto, and control unit for controlling the heater control unit to control the heater within a copying period during which a copying operation is completed. The heater control unit on-off controls the heater only during the copying operation. Accordingly, power consumed by the heater is reduced and a temperature increase within the apparatus can be suppressed.

12 Claims, 4 Drawing Sheets

IMAGE FORMING APPARATUS PROVIDED WITH A CONTROLLER FOR FIXING ROLLER HEATER

BACKGROUND OF THE INVENTION AND RELATED ART STATEMENT

This invention relates to a copying machine or like image forming apparatus, and more particularly to a control system for controlling a fixing unit provided in the image forming apparatus.

A fixing unit provided in an existing image forming apparatus such as a copying machine includes a fixing roller and a pressing roller. The fixing unit heats a copy sheet at a predetermined fixing temperature while transporting it. whereby fixing a transferred image onto the copy sheet. The fixing roller is provided with a heater for heating the fixing roller and a temperature detector including a thermistor for detecting the temperature of the fixing roller. The temperature of the fixing roller is maintained in a predetermined temperature range by turning on and off the heater at appropriate timings, i.e., on-off controlling the heater in accordance with the temperature detected by the temperature detector.

The fixing unit is activated when the image forming apparatus is powered on. While power is applied to the image forming apparatus, the temperature of the fixing roller is maintained at a predetermined stand-by temperature near the fixing temperature so that a copying operation can be executed any time. Upon start of the copying operation, the temperature of the fixing roller is increased from the stand-by temperature to the fixing temperature, and decreased from the fixing temperature to the stand-by temperature again upon completion of the copying operation.

Recently, a multitude of functions and high performance have been required for an image forming apparatus as an office machine. However, there has also existed an increasing demand for a low cost image forming apparatus having a simplified and small-sized construction. A simplified and small-sized image forming apparatus is realizable by reducing the number of various functions and sensors or making them smaller. Such an apparatus will be power-saving and can be manufactured at a low cost.

For example, the image forming apparatus may have a simple construction by reducing the number of complicated control mechanisms such that copy sheets are manually fed one by one thereto. Further, detection of jam of a copy sheet may be left in an operator's hand. In other words, the operator may discriminates whether the jam has occurred based on whether or not the copy sheet has discharged within a specified period following start of a copying operation. In this way, a jam sensor can be dispensed with. Furthermore, the image forming apparatus can be manufactured at a low cost if various components as well as a main body of the apparatus are formed with low cost resin.

However, promotion of small-sized and low cost image forming apparatus is at variance with the use of material having high heat resistance and makes it difficult to provide a space for releasing the heat and heat releasing members within the apparatus. This requires measures to reduce an amount of heat generated within the apparatus.

Particularly, in the case where a fixing unit provided with a conventional control system is applied in a simple and small-sized image forming apparatus, the temperature of a fixing roller is controlled using a heater all the time while power is applied to the apparatus. Accordingly, it is difficult to suppress a temperature increase within the apparatus.

Further, in this apparatus, the heater is kept energized even during the time while the copying operation is not executed as long as power is applied to the apparatus. Accordingly, the apparatus is obliged to consume more power than necessary.

Moreover, in the case where, for example, power outage occurs while the copy sheet is being transported in the fixing unit causing a copy sheet jam therein, it is not to be discriminated whether the copy sheet has been discharged within a predetermined period. Therefore, the apparatus cannot detect the jam. The copy sheet remaining in the fixing unit is heated by the fixing roller for a long time until a next copying operation, thereby causing problems such as burning of the copy sheet and fire.

SUMMARY OF THE INVENTION

It is an object of the present invention to provide an image forming apparatus capable of maximally reducing a period during which power is applied to a heater provided in a fixing unit, whereby suppressing a temperature increase in the apparatus and consuming as little power as possible.

Accordingly, an image forming apparatus of the invention comprises image forming means for forming and transferring an image of a document to a copy sheet, fixing means including a fixing roller for fixing the document image to the copy sheet while transporting it, heater means for heating the fixing roller, and heater control means for turning on and off the heater means at specified timings so as to increase and maintain temperature of the fixing roller to and in a predetermined steady-state temperature range whose upper limit is a fixing temperature, the copy sheet being heated by the fixing roller having temperature of about the predetermined fixing temperature while transported, whereby the document image transferred to the copy sheet is fixed thereto, and control means for controlling the heater control means to control the heater means within a copying period during which a copying operation is completed.

With the image forming apparatus thus constructed, the heater means provided in the fixing means is on-off controlled only during the copying operation, and kept off in a stand-by state where the copying operation is not executed. Accordingly, an amount of heat accumulated in the fixing roller can be reduced and a temperature increase within the apparatus can be suppress. In addition, power consumed by the heater means is reduced, making the apparatus power-saving.

Further, the control means may start controlling the heater control means before driving of the fixing roller is started. With this arrangement, even in the case where a copy sheet is caused to remain in the fixing means by a power outage or like event, the remaining copy sheet is discharged by rotation of the fixing roller before the temperature of the fixing roller reaches up to the fixing temperature. Thus, it can be prevented that the remaining copy sheet is heated to be burnt or to case a fire.

Also, the heater control means may stop controlling the temperature of the fixing roller before a trailing end of the copy sheet passes the fixing roller by a predetermined period, whereby the toner image is fixed to a rear portion of the copy sheet with the remaining heat of the fixing roller. The control stop timing of the heater control means may be designated, for example, by means of measurement of a preset period following start of the copying operation with the use of a timer or detection that the copy sheet is transported a predetermined distance by the fixing roller.

With this arrangement, the heat accumulated in the fixing roller and power consumed by the heater means can be reduced, and thereby suppression of the temperature increase and power-saving of the apparatus can be further improved.

In addition, an image forming apparatus of the invention may further comprise temperature detector means for detecting temperature of the fixing roller when the heater means is first turned on during the copying operation and calculation means for calculating, based on the temperature detected by the temperature detector means, a transient period during which the heater means is kept on after first turned on in the copying operation, the transient period being such that the temperature of the fixing roller increasing even after the end of the transient period is peaked at the fixing temperature wherein the heater control means keeps the heater means on during the transient period calculated by the calculation means to increase the temperature of the fixing roller to the predetermined fixing temperature.

Preferably, a conversion table defining relationship the temperature of the fixing roller detected by the temperature detector means and corresponding transient period is stored, and the transient period is determined based on the detection result of the temperature detector means using this conversion table.

With the image forming apparatus thus constructed, the calculation means calculates such a transient period that the temperature of the fixing roller increasing even after the end of the transient period due to the remaining heat of the fixing roller is peaked at the fixing temperature. By energizing the heater means for the transient period, the temperature of the fixing roller increased to the predetermined fixing temperature.

More specifically, during the transient period, the heater means is turned off before the temperature of the fixing roller reaches the fixing temperature, and then the temperature of the fixing roller is increased to the fixing temperature with the remaining heat. Accordingly, an amount of power applied to the heater means is reduced, which in turn saves power consumed by the apparatus as a whole. Further, since the temperature of the fixing roller will not exceed the fixing temperature despite the temperature increase caused by the remaining heat, it can be prevented that the toner image is fixed to the copy sheet unsatisfactorily due to the toner fused too much.

These and other objects, features and advantages of the present invention will become more apparent upon a reading of the following detailed description and accompanying drawings.

DETAILED DESCRIPTION OF PREFERRED EMBODIMENTS OF THE INVENTION

Figure 2:
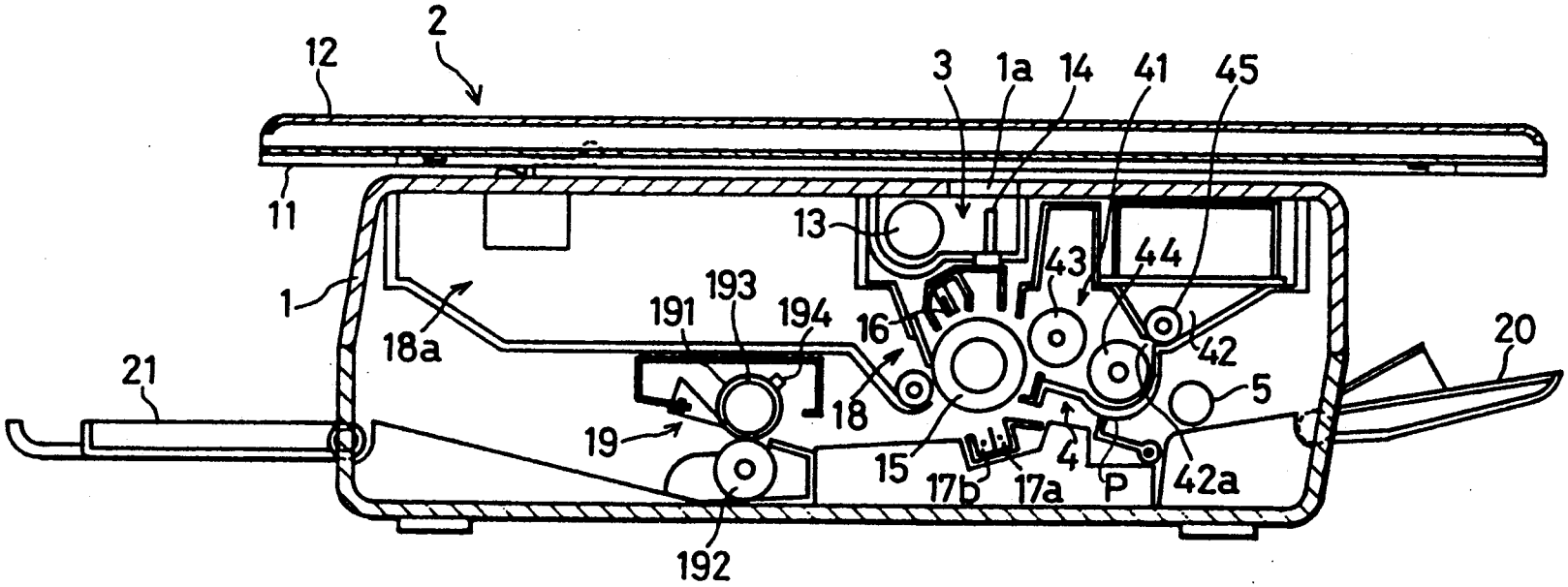
FIG. 2 is a schematic front view in section showing a construction of the image forming apparatus.

FIG. 2 is a schematic front view in section showing a construction of an image forming apparatus in accordance with the invention. The apparatus shown in this figure is a low cost image forming apparatus having a small and simplified construction, and has a table 2 movable reciprocatingly at a top thereof and a main body 1 below the table 2. The table 2 is provided with a platen glass 11 and a document holder 12. The apparatus main body 1 consists of an upper body section and a lower body section, which are separably attached to each other.

A slit 1*a* extending vertically to the drawing of FIG. 2 for exposing a document is defined at a center of an upper surface of the upper body section of the main body 1. Besides, the followings are provided in the upper body section. An image reading station 3 including an exposure lamp 13, condenser lens 14, and the like is arranged below the slit 1*a*. Below the image reading station 3 is disposed a photosensitive drum 15, and a main charger 16, developing unit 4, cleaning unit 18 are arranged around the drum 15 in this order from a most upstream side. Further, a recirculated developer container 18*a* is provided in a left side portion (in the drawing of FIG. 2) of the cleaning unit 18.

The developing unit 4 is provided with a developing device 41 and a toner container 42 for staring supplementary toner therein. In the developing device 41 are disposed a developing roller 43 opposing to the photosensitive drum 15 and an agitating roller 44 below an opening 42*a* formed at a bottom of the toner container 42. The agitating roller 44 agitates developer consisting of toner and carrier. In the toner container 42 is disposed a toner supply roller 45 above the opening 42*a* in such a manner that a portion of a circumferential surface of the roller 45 closes the opening 42*a*.

On the other hand, in the lower body section of the main body 1 are provided a sheet insertion guide 20 disposed at a right end side thereof, and a discharge tray 21 disposed at a left end side thereof in the drawing of FIG. 2. A copy sheet is supplied along the sheet insertion guide 20 and discharged to the discharge tray 21 after having a document image copied thereon. Further, there are provided a feed roller 5, transfer charger 17*a*. separating charger 17*b*. and fixing unit 19 along a direction of transport of the copy sheet between the trays 20, 21.

The fixing unit 19 includes a fixing roller 191 and a pressing roller 192. The copy sheet having a toner image transferred thereto is transported to between the fixing roller 191 and pressing roller 192. Thereupon, the toner image is fused and pressed onto the copy sheet respectively by the fixing roller 191 and pressing roller 192 while the copy sheet is transported toward the discharge tray 21. Consequently, the copy sheet is discharged to the discharge tray 21. The fixing roller 191 is internally provided with a heater 193, and a thermistor (temperature detector) 194 is disposed in an appropriate position in the vicinity of the fixing roller 191. The thermistor 194 detects surface temperature of the fixing roller 191.

A complete main body 1 of the image forming apparatus is obtainable by properly connecting the upper and lower body sections to each other.

In the present embodiment, in order to simplify a control system for a copying operation, the construction of the image forming apparatus is such that a document image is transferred to each of copy sheets manually fed one by one. In other words, a copying operation is conducted each time a copy sheet is inserted to the feed roller 5 along the sheet insertion guide 20. Reflecting this copying operation, the fixing unit 19 is driven for each copying operation, whereby shortening a transient period of the heater 193 as much as possible to maximally suppress a temperature increase in the interior of the apparatus main body 1.

In view of this, the heater 193 has a relatively large capacity so that it can increase the temperature of the fixing roller 191 to a predetermined fixing temperature for a short period (several seconds) required for the copy sheet to be transported to the fixing roller 191 following the start of the copying operation.

Next, there will be described a copying operation. After a document Is placed in a specified position on the platen glass 11, the copy sheet is inserted along the sheet insertion guide 20 until a leading end thereof reaches the feed roller 5. Thereupon, the leading end of the copy sheet is detected by an unillustrated copy sheet sensor, which in turn sends a corresponding sensor signal. Upon receipt of this sensor signal, a control unit to be described later starts executing the copying operation.

The leading end of the copy sheet is transported by the feed roller 5 to a point P where transport of the copy sheet is paused temporarily. A table 2, which is initially positioned at a center (initial position), moves to the left. Upon a right end of the table 2 reaching a position above the slit 1*a*, the table 2 starts moving to the right while scanning the document. At this time, the exposure lamp 13 emits light which in turn illuminates the document surface through the slit 1*a*. The light reflected by the document surface is projected to the surface of the photosensitive drum 15 by way of the condenser lens 14.

The surface of the drum 15 is charged by the main charger 16 so as to attain a specified potential while being rotated. At an exposure position, the reflected light is projected to the surface of the drum 15, whereby an electrostatic latent image of the document is formed thereon.

Transport of the copy sheet waiting in stand-by at point P is started at a specified timing while the electrostatic latent image is developed by the developing unit 4. The developed document image is transferred by the transfer charger 17*a* onto the copy sheet, which is separated from the surface of the drum 15 by the separating charger 17*b*. The copy sheet is discharged to the discharge tray 21 after the transferred document image is fixed to the copy sheet in the fixing unit 19.

After the document image is transferred to the copy sheet, the developer residual on the surface of the drum 15 is cleaned by the cleaning unit 18, and the surface of the drum 15 is charged by the main charger 16 again. The above image forming operation is repeated a required number of times in the same manner until a complete image of one document is transferred onto the copy paper. This is because a circumference of the drum 15 is shorter than a length of the document in a document scanning direction. Hence, it is necessary that the document image is divided into two or more sub-images and that the sub-images are transferred onto the copy sheet one after another in synchronism with each turn of the drum 15. Accordingly, it takes about 7 to 8 seconds to make a complete copy from one document.

During the image forming operation, the table 2 has its moving direction reversed and returns to the initial position upon completion of scanning of the document.

Figure 1:
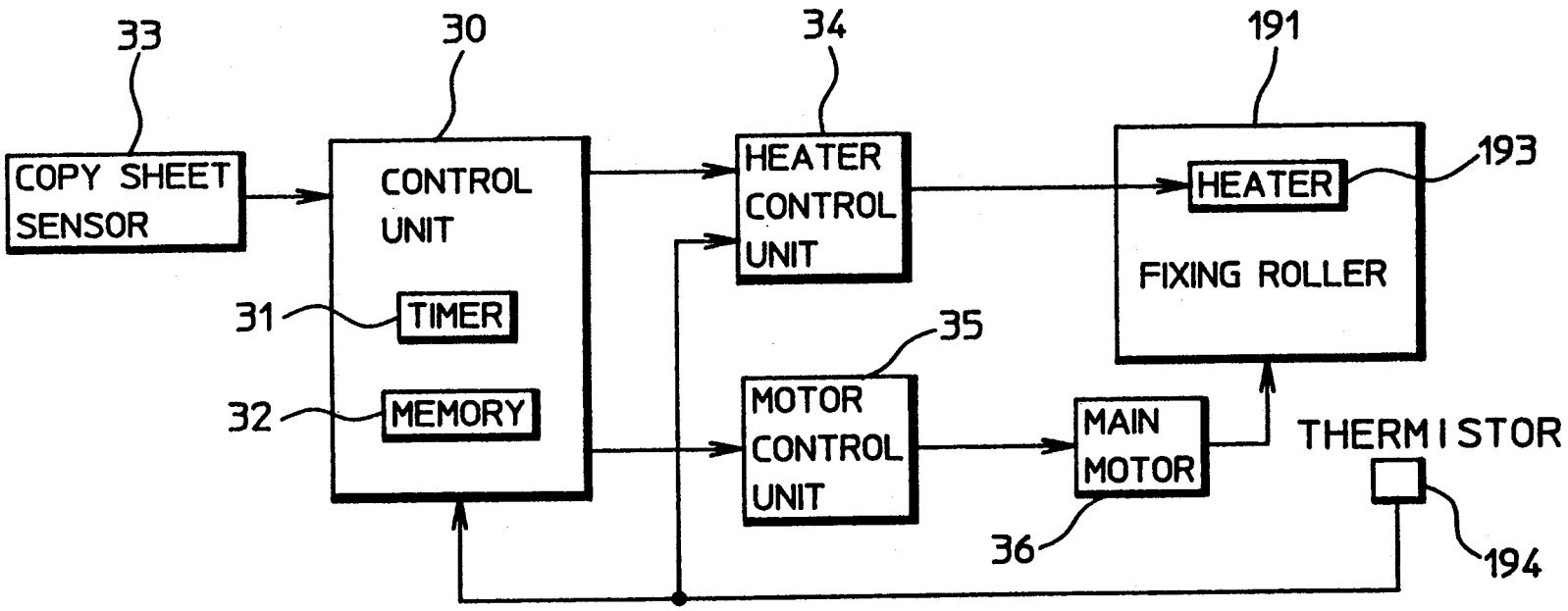
FIG. 1 is a block diagram showing a control system for controlling a fixing unit provided in an image forming apparatus in accordance with the invention.

FIG. 1 is a block diagram showing a control system for controlling the temperature of the fixing unit 19.

In FIG. 1, indicated at 30 is a control unit 30 for centrally controlling the copying operation, including controlling of driving of the fixing unit 19. The control unit 30 is internally provided with a timer 31 and a memory 32. The timer 31 measures timings at which driving of a main motor 36 is stopped and an on-off control of the heater 193 is started or stopped. The memory 32 stores data to be used for calculating a transient period tk of the heater 193. The transient period tk of the heater 193 will be described more in detail later.

A copy sheet sensor 33 detects insertion of the copy sheet along the sheet insertion guide 20 and sends a sensor signal representative of detection result to the control unit 30. The control unit 30 starts executing the copying operation upon receipt of this sensor signal.

Temperature information of the fixing roller 191 detected by the thermistor 194 is input to the control unit 30 and heater control unit 34. The control unit 30 calculates the transient period tk of the heater 193 based on the temperature information from the thermistor 194. The calculated transient period tk is sent to the heater control unit 34.

The control unit 30 sends heater control signals to the heater control unit 34 and drive control signals to a motor control unit 35.

The heater control unit 34 controls application of power to the heater 193 by turning on and off the heater 193. The heater control unit 34 turns on the heater 193 upon receipt of a heater-on signal and the transient period tk sent from the control unit 30. The heater control unit 34 keeps heater 193 on during the transient period tk, and then turns on and off the heater 193 at appropriate timings based on the temperature information from the thermistor 194 so as to maintain the temperature of the fixing roller 191 in a predetermined steady-state temperature range (between the fixing temperature and a lower temperature limit) during one copying operation.

The motor control unit 35 controls driving of the main motor 36 in accordance with the drive control signal from the control unit 30. The main motor 36 serves as driving source for the photosensitive drum 15. Further, the driving force of the motor 36 is transmitted to the fixing roller 191 and pressing roller 192 by way of unillustrated clutches, gears and like transmission mechanism. In this respect, the motor 36 also serves as driving source for the rollers 191, 192. Accordingly, the fixing roller and pressing roller 191, 192 are drivingly rotated together with the photosensitive drum 15.

Upon receipt of the sensor signal from the copy sheet sensor 33, the control unit 30 sends a drive start signal to the motor control unit 35, which in turn causes the main motor 36 to be driven. At the same time, the control unit 30 causes the timer 31 to start measuring a preset copying period. When the timer 31 completes measurement of the preset copying period, the control unit 30 sends a drive stop signal to the motor control unit 35, which in turn causes the main motor 36 to stop being driven.

It should be noted that the copying period refers to a time required for copying a document image onto the copy sheet. More specifically, it is a period which lasts until the copy sheet is discharged to the discharge tray 21 following insertion of the copy sheet along the copy sheet tray 20 to the predetermined position.

Further, a temperature control of the fixing unit 19 is executed only during the copying operation. Accordingly, the motor control unit 35 sends a heater control enabling signal to the heater control unit 34 while executing the drive control of the main motor 36. The heater control unit 34 controls the heater 193 in accordance with the heater control signals from the control unit 30 only while the heater control enabling signal is sent thereto.

Next, operations of the control unit 30 will be described with reference to a timing chart shown in FIG. 3.

Figure 3:
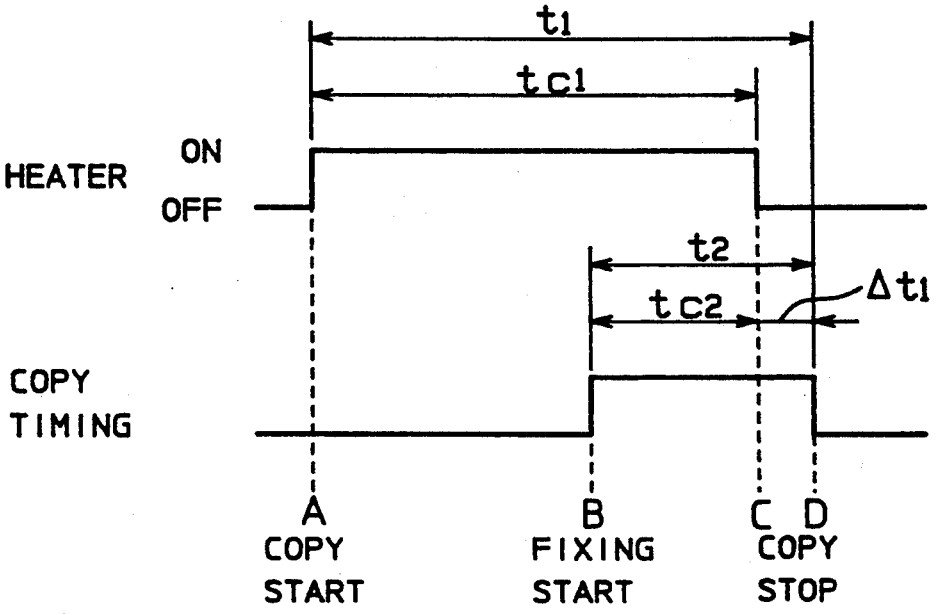
FIG. 3 is a timing chart for showing a temperature control period during which a temperature control of the fixing unit is executed.

At point A in FIG. 3, it is detected that the copy sheet is inserted along the sheet insertion guide 20 to the predetermined position, whereupon the control unit 30 sends the drive start signal to the motor control unit 35 and starts the timer 31. The motor control unit 35, upon receipt of the drive start signal, starts the driving of the main motor 36 and sends the heater control enabling signal to the heater control unit 34. The driving of the main motor 36 causes the photosensitive drum 15 to start drivingly rotating together with the fixing roller and pressing roller 191, 192. In addition, the heater control unit 34 is brought to a state where the heater control is executable upon receipt of the heater control enabling signal.

In this way, the driving of the fixing roller 191 is started before the temperature thereof reaches the fixing temperature. Accordingly, even in the case where a power outage or like event occurs during the copying operation and the copy sheet remains in the fixing unit 19 therefor, the remaining copy sheet is transported by the fixing and pressing rollers 191. 192 and discharged to the discharge tray 21 when the next copying operation is started. Hence, the copy sheet remaining in the fixing unit 19 is neither to be discolored nor to be burnt due to the heat offered from the fixing roller 191.

Subsequently, the control unit 30 reads a temperature Ts of the fixing roller 191 shown in FIG. 4 and calculates the transient period tk of the heater 193 based on the current temperature Ts. The transient period tk is a period during which the heater 193 is kept on so as to increase the temperature of the fixing roller 191 to a temperature slightly below a predetermined fixing temperature, e.g., 180° C. from the temperature Ts. Further, the control unit 30 sends the heater-on signal to the heater control unit 34, which then turns on the heater 193.

Upon the timer 31 measuring the transient period tk, the control unit 30 sends a heater-off signal to the heater control unit 34 to turn off the heater 193. In addition, the control unit 30 sends an on-off control start signal to the heater control unit 34. Upon receipt of the on-off control start signal, the heater control unit 34 turns on and off the heater 193 at appropriate timings based on the temperature information from the thermistor 194, whereby maintaining the temperature of the fixing roller 191 in the steady-state temperature range.

The transient period tk is shorter than a period tp required for the temperature of the fixing roller 191 to rise from the temperature Ts to the fixing temperature due to the heat offered from the heater 193 by a predetermined period Δt2. Even after the heater 193 is turned off, the temperature of the fixing roller 191 rises a certain amount (overshoot amount) due to the remaining heat. The period Δt2 is a time required for the temperature of the fixing roller 191 to rise with the remaining heat from a temperature of the fixing roller 191 at the end of the transient period tk to the fixing temperature.

Figure 4:
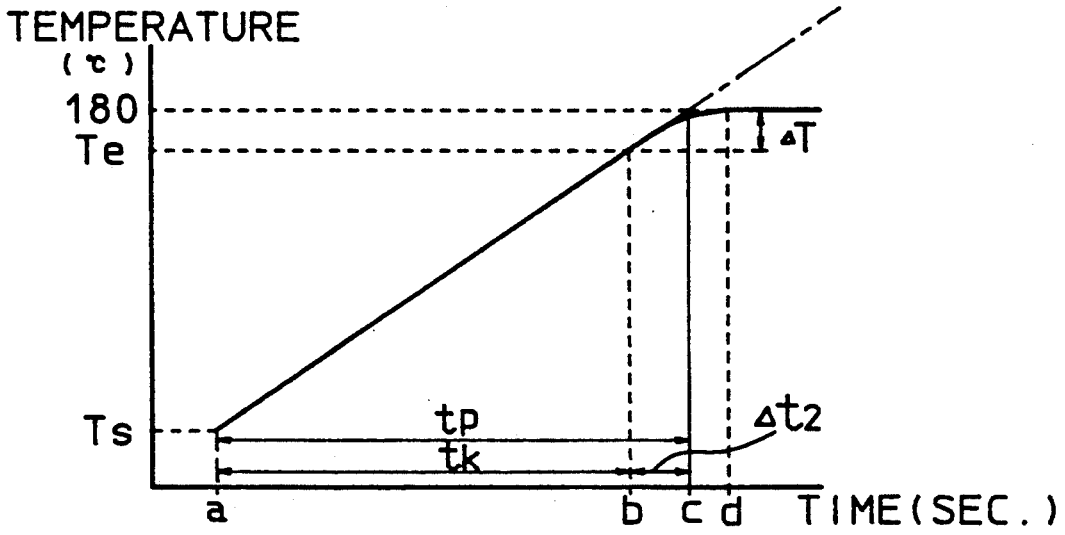
FIG. 4 is a graph showing a temperature change of a fixing roller immediately after the temperature control of the fixing unit is started.

In other words, the transient period tk is represented as a time interval ab which is a time interval ac minus a time interval bc in a time axis in FIG. 4 wherein: c is a point where the temperature of the fixing roller 191 reaches the fixing temperature due to the heat from the heater 193; and b is a point where the heater 193 is turned off, so that the overshoot amount will bring a peak temperature of the fixing roller 191 to the fixing temperature at point d.

The period Δt2 varies depending upon the transient period tk of the heater 193, i.e., an amount of heat accumulated in the fixing roller 191 and differs according to the temperature Ts of the fixing roller 191 when the heater 193 is turned on at point a. The period Δt2 corresponding to the temperature Ts at the start of the temperature control may be obtained empirically in advance.

The memory 32 stores a conversion table defining relationship between the current temperature Ts and transient period tk of the heater 193. In this embodiment, the control unit 30 directly determines the transient period tk from the temperature Ts detected by the thermistor 194 using the conversion table.

As described above, the heater 193 is turned off before the temperature of the fixing roller 191 reaches the fixing temperature at the end of the transient period tk. Accordingly, an amount of power applied to the heater 193 is reduced, which contributes to power-saving of the image forming apparatus as a whole. If the toner is fused too much at temperatures higher than the fixing temperature, some of the fused toner deposits on the surface of the fixing roller 191 to stain the copy sheet and the document image cannot be copied on the copy sheet beautifully. In view of this, the heater 193 is so controlled that the temperature of the fixing roller 191 will not exceed the fixing temperature despite the overshoot caused by the remaining heat. Accordingly, it can be prevented that the toner image is fixed in an unsatisfactory manner due to the toner fused too much at high temperatures.

The transient period tk of the heater 193 may be calculated based on the temperature Ts and a rate of temperature change K of the fixing roller 191 using a specified operational expression. For instance, the transient period tk may be calculated as follows. Firstly, a temperature Te is calculated which is lower than the fixing temperature of 180° C. by an overshoot amount ΔT. The overshoot amount ΔT is an increase in the temperature of the fixing roller 191 which is caused by the remaining heat after the heater 193 is turned off at the end of the transient period tk. Then, the transient period tk is calculated based on the temperatures Te, Ts, and rate of temperature change K using the following expression:

$$tk = (Te - Ts)/K$$

The overshoot amount ΔT varies depending upon the transient period tk of the heater 193, i.e., an amount of heat accumulated in the fixing roller 191, and differs according to temperature Ts of the fixing roller 191 at the time when the temperature control is started. The overshoot amount ΔT may be obtained empirically in advance.

Referring back to FIG. 3, upon the timer 31 measuring a preset heater control period tc1 at point C, the control unit 30 sends a heater control stop signal to the heater control unit 32. The heater control unit 32, upon receipt of the heater control stop signal, stops executing the on-off control of the heater 193, consequently finishing the temperature control for maintaining the temperature of the fixing roller 191 in the steady-state temperature range.

The heater control period tc1 is a time for determining a stop timing (point C) at which the temperature control of the fixing roller 191 is finished. Indicated at t1 in FIG. 3 is a copying period for determining a copy stop timing (point D) at which a trailing end of the copy sheet passes the fixing roller 191. The copying period lasts until the point D following the start of the copying operation at point A. The heater control period tc1 is set shorter than the copying period t1 by a predetermined period Δt1.

Immediately after the heater 193 is turned off at point C, the temperature of the fixing roller 191 is still near the fixing temperature. The predetermined period Δt1 is a time during which the toner image can be fixed to a rear portion of the copy sheet using the remaining heat of the fixing roller 191. For instance, the period Δt1 is set at such a time required for the temperature of the fixing roller 191 to fall 4° to 5° C. from the fixing temperature of, e.g., 180° C. The period Δt1 is substantially constant due to heat releasing characteristics of the fixing roller 191, and therefore can be obtained empirically.

The heater control period tc1 is calculated by subtracting the predetermined period Δt1 from the copying period t1. This calculation result is stored in the memory 32 in advance.

Since the heater control period tc1 determines a heater control stop timing at which the heater control unit 34 stops executing the on-off control of the heater 193, a reference point for the heater control stop timing is not limited to the copying operation starting point A. Such a reference point can be set in any desired stage of the copying operation. For instance, a copy sheet sensor may be provided in the fixing unit 19 to detect the point B where fixing of the toner image to the copy sheet is started in order to use the point B as a reference point for the heater control stop timing. In this case, a heater control period tc2 is obtained by subtracting the predetermined period Δt1 from a fixing period t2 (time interval BD) required for a complete image fixing operation.

Figure 5:
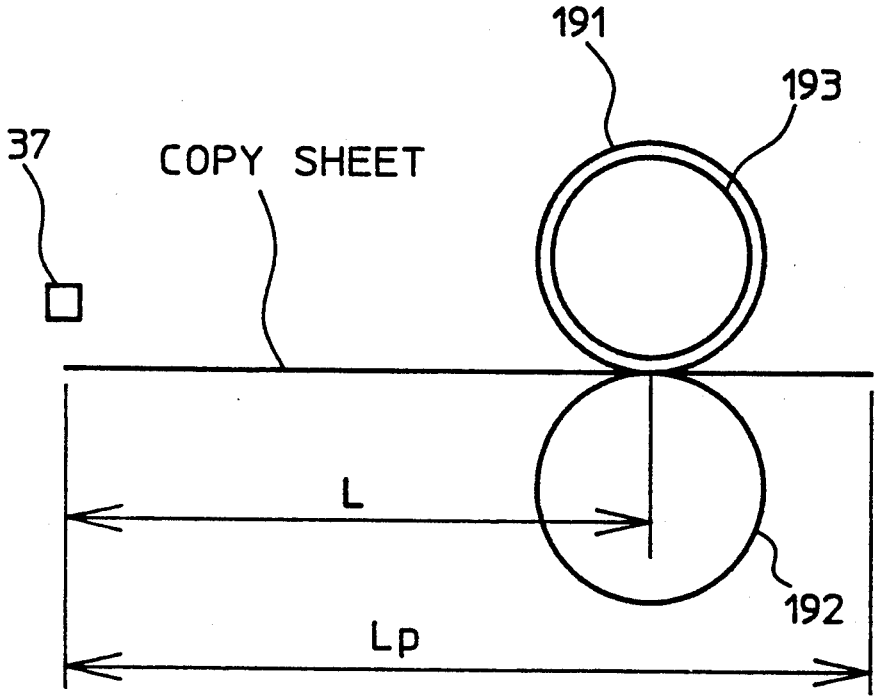
FIG. 5 is a diagram showing another arrangement for determining a timing at which the temperature control of the fixing unit is stopped.

The heater control stop timing may be designated to the heater control unit 34 directly, i.e., without calculation. For instance, an arrangement as shown in FIG. 5 may be made. A copy sheet sensor 37 is provided in a specified position along the sheet transport direction away from the fixing roller 101 to a more downstream side by a distance L. The distance L is shorter than a length Lp of the copy sheet in the sheet transport direction by a certain amount. The copy sheet sensor 37 sends a sensor signal representative of detection of the leading end of the copy sheet. The heater control unit 34 is caused to stop on-off controlling the heater 193 in accordance with the sensor signal from the copy sheet sensor 37. If the heater control unit 34 stops on-off controlling the heater 193 at the aforementioned timing, the toner image is fixed to a rear portion of the copy sheet having a length of (Lp−L) using the remaining heat of the fixing roller 191.

As described above, the temperature control of the fixing roller 191 is executed for each copying operation, shortening a power application period during which power is applied to the heater 193. As a result, it is made possible to suppress a temperature increase within the image forming apparatus and save the amount of power consumed thereby.

Particularly, since the temperature control is finished before the trailing end of the copy sheet passes the fixing roller 191, the power application period can be further shortened. This further promotes suppression of the temperature increase within the image forming apparatus and saving of power.

In the present embodiments, the aforementioned heater control is applied to the fixing unit of the roller type. However, it will be understood that the heater control may be applied to a fixing unit of the oven fusing type or the like.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An image forming apparatus comprising:

image forming means for forming and transferring an image of a document to a copy sheet, the copy sheet having a leading end and a trailing end;

feeding means for feeding the copy sheet to the image forming means;

fixing means including:

a fixing roller for fixing the transferred document image on the copy sheet while transporting it; and heater means for heating the fixing roller, the heater means having an on-state for heating the fixing roller and an off-state in which the fixing roller is not heated; and control means for setting the heater means in the on-state after an elapse of a predetermined time following a start of feeding of the copy sheet, until a predetermined time before the trailing end of the copy sheet passes off of the fixing roller.

2. An image forming apparatus as defined in claim 1 comprising means for driving the fixing roller before the heater means is set into the on-state.

3. An image forming apparatus as defined in claim 1 wherein the control means includes a timer for measuring an on-state period after the heater means is set to the on-state, and the control means comprises means for changing the heater means from the on-state to the off-state when the timer measures the end of the on-state period, the on-state period being shorter than a copying period, a copying period being a duration from the time at which the heater means is set to the on-state to the timer at which the trailing end of the copy sheet passes off the fixing roller.

4. An image forming apparatus as defined in claim 1 wherein the control means includes sensor means disposed away from the fixing roller on a downstream side by a distance shorter than a length between the leading end and the trailing end of the copy sheet, said sensor being positioned to detect the leading end, and the control means comprises means for changing the heater means from the on-state to the off-state when the sensor means detects the leading end of the copy sheet.

5. An image forming apparatus as defined in claim 1 wherein the control means includes a secondary controller for controlling the heater means so as to keep a temperature of the fixing roller in a predetermined fixing temperature range in the on-state of the heater means.

6. An image forming apparatus as defined in claim 5 further comprising:

temperature detector means for detecting an initial temperature of the fixing roller immediately before the heater means is put in the on-state; and calculation means responsive to the temperature detector means for calculating a transient period to increase the temperature of the fixing roller from the detected initial temperature to the predetermined fixing temperature;

wherein the control means keeps the heater means in the on-state during the calculated transient period.

7. An image forming apparatus comprising:

image forming means for forming and transferring an image of a document to a copy sheet, the copy sheet having a leading end and a trailing end;

feeding means for feeding the copy sheet to the image forming means;

fixing means including:

a fixing roller for fixing the transferred document image on the copy sheet while transporting it; and heater means for heating the fixing roller, the heater means having an on-state for heating the fixing roller and an off-state in which the fixing roller is not heated; and control means for setting the heater means in the on-state after an elapse of a predetermined time following a start of feeding of the copy sheet, until a predetermined time before the trailing end of the copy sheet passes off of the fixing roller; and further comprising means for driving the fixing roller before the heater means is set into the on-state.

8. An image forming apparatus comprising:

image forming means for forming and transferring an image of a document to a copy sheet, the copy sheet having a leading end and a trailing end;

feeding means for feeding the copy sheet to the image forming means;

fixing means including:

a fixing roller for fixing the transferred document image on the copy sheet while transporting it; and heater means for heating the fixing roller, the heater means having an on-state for heating the fixing roller and an off-state in which the fixing roller is not heated; and control means for setting the heater means in the on-state after an elapse of a predetermined time following a start of feeding of the copy sheet, until a predetermined time before the trailing end of the copy sheet passes off of the fixing roller;

said control means including a timer for measuring an on-state period after the heater means is set to the on-state, and the control means comprises means for changing the heater means from the on-state to the off-state when the timer measures the end of the on-state period, the on-state period being shorter than a copying period, a copying period being a duration from the time at which the heater means is set to the on-state to the time at which the trailing end of the copy sheet passes off the fixing roller.

9. An image forming apparatus comprising:

image forming means for forming and transferring an image of a document to a copy sheet, the copy sheet having a leading end and a trailing end;

feeding means for feeding the copy sheet to the image forming means;

fixing means including:

a fixing roller for fixing the transferred document image on the copy sheet while transporting it; and heater means for heating the fixing roller, the heater means having an on-state for heating the fixing roller and an off-state in which the fixing roller is not heated; and control means for setting the heater means in the on-state after an elapse of a predetermined time following a start of feeding of the copy sheet, until a predetermined time before the trailing end of the copy sheet passes off of the fixing roller;

said control means including sensor means disposed away from the fixing roller on a downstream side by a distance shorter than a length between the leading end and the trailing end of the copy sheet, said sensor being positioned to detect the leading end, and the control means comprises means for changing the heater means from the on-state to the off-state when the sensor means detects the leading end of the copy sheet.

10. An image forming apparatus comprising:

image forming means for forming and transferring an image of a document to a copy sheet, the copy sheet having a leading end and a trailing end;

feeding means for feeding the copy sheet to the image forming means;

fixing means including:

a fixing roller for fixing the transferred document image on the copy sheet while transporting it; and heater means for heating the fixing roller, the heater means having an on-state for heating the fixing roller and an off-state in which the fixing roller is not heated; and control means for setting the heater means in the on-state after an elapse of a predetermined time following a start of feeding of the copy sheet, until a predetermined time before the trailing end of the copy sheet passes off of the fixing roller;

said control means including a secondary controller for controlling the heater means so as to keep a temperature of the fixing roller in a predetermined fixing temperature range in the on-state of the heater means; and further comprising:

temperature detector means for detecting an initial temperature of the fixing roller immediately before the heater means is put in the on-state; and calculation means responsive to the temperature detector means for calculating a transient period to increase the temperature of the fixing roller from the detected initial temperature to the predetermined fixing temperature;

wherein the control means keeps the heater means in the on-state during the calculated transient period.

11. An image forming apparatus comprising:

image forming means for forming and transferring an image of a document to a copy sheet, the copy sheet having a leading end and a trailing end;

feeding means for feeding the copy sheet to the image forming means;

fixing means including:

a fixing roller for fixing the transferred document image on the copy sheet while transporting it; and heater means for heating the fixing roller, the heater means having an on-state for heating the fixing roller and an off-state in which the fixing roller is not heated; and control means for setting the heater means in the on-state after an elapse of a predetermined time following a start of feeding of the copy sheet, until a predetermined time before the trailing end of the copy sheet passes off of the fixing roller, whereby said heater is set to said on-state for a time less than the time required for the copy sheet pass said fixing roller from said leading end to said trailing end thereof.

12. An image forming apparatus as defined in claim 10 wherein the calculation means includes memory means for storing a relationship between initial temperatures of the fixing roller and respective transient periods corresponding to the initial temperatures, and the calculation means calculates a transient period based on a detected initial temperature and the relationship stored in the memory means.

* * * * *